US012078166B2

(12) United States Patent
Metz et al.

(10) Patent No.: US 12,078,166 B2
(45) Date of Patent: Sep. 3, 2024

(54) SCREW SPINDLE PUMP

(71) Applicant: LEISTRITZ PUMPEN GMBH, Nuremberg (DE)

(72) Inventors: Jürgen Metz, Feucht (DE); Kristin Lissek, Fürth (DE); Florian Popp, Nuremberg (DE)

(73) Assignee: LEISTRITZ PUMPEN GMBH, Nuremberg (DE)

( * ) Notice: Subject to any disclaimer, the term of this patent is extended or adjusted under 35 U.S.C. 154(b) by 0 days.

(21) Appl. No.: 18/078,274

(22) Filed: Dec. 9, 2022

(65) Prior Publication Data

US 2023/0184249 A1 Jun. 15, 2023

(30) Foreign Application Priority Data

Dec. 14, 2021 (DE) ..... 10 2021 133 114.5

(51) Int. Cl.
*F04C 15/06* (2006.01)
*F01C 21/10* (2006.01)
(Continued)

(52) U.S. Cl.
CPC ..... *F04C 15/06* (2013.01); *F01C 21/108* (2013.01); *F04C 2/086* (2013.01); *F04C 2/16* (2013.01)

(58) Field of Classification Search
CPC .. F01C 21/10; F04C 15/06; F04C 2/16; F04C 2220/00; F04C 2230/60; F04C 2240/60;
(Continued)

(56) References Cited

U.S. PATENT DOCUMENTS 3,269,328 A * 8/1966 Sennet ..... F01C 21/10 418/197
6,152,719 A 11/2000 Nelik
(Continued)

FOREIGN PATENT DOCUMENTS

DE 102013102031 A1 9/2014
DE 102019118094 A1 1/2021
(Continued)

OTHER PUBLICATIONS

German Office Action Dated Sep. 6, 2022, 8 Pages.
(Continued)

*Primary Examiner* — Wesley G Harris
(74) *Attorney, Agent, or Firm* — LUCAS & MERCANTI, LLP; Klaus P. Stoffel

(57) ABSTRACT

A screw spindle pump having a spindle housing, in which a drive spindle and at least one running spindle which meshes therewith are received in spindle bores, an outer housing which encloses the spindle housing, and a cover component which is placed axially onto the outer housing and on which both an axial fluid inlet port and a lateral fluid outlet port are provided, wherein the fluid inlet port communicates with a fluid inlet of the spindle housing and the fluid outlet port communicates with a fluid outlet of the spindle housing, wherein the cover component is fastenable to the outer housing in a plurality of marked rotational positions with a first pitch, and wherein the spindle housing is fastenable to the cover component and/or in the outer housing in a plurality of marked rotational positions with a second, smaller pitch.

19 Claims, 9 Drawing Sheets

(51) Int. Cl.
*F04C 2/08* (2006.01)
*F04C 2/16* (2006.01)

(58) Field of Classification Search
CPC ..... F04C 2240/30; F04C 2240/806; F04C 11/001; F04C 2240/805
See application file for complete search history.

(56) References Cited

U.S. PATENT DOCUMENTS

| | | | | |
|---|---|---|---|---|
| 7,862,315 | B2 | 1/2011 | Rohlfing | |
| 9,759,214 | B2 | 9/2017 | Nuss | |
| 9,765,776 | B2 * | 9/2017 | Metz | F04C 2/16 |
| 10,947,970 | B2 * | 3/2021 | Trossmann | F04C 2/16 |
| 11,319,953 | B2 | 5/2022 | Richter | |
| 2011/0103987 | A1 * | 5/2011 | Kothnur | F04C 2/084 29/888.023 |
| 2021/0123437 | A1 * | 4/2021 | Richter | F04C 2/16 |
| 2022/0344747 | A1 | 10/2022 | Pawellek | |

FOREIGN PATENT DOCUMENTS

| | | | | |
|---|---|---|---|---|
| DE | 102019128602 | B3 | 2/2021 | |
| JP | 2008542605 | A | 11/2008 | |
| WO | WO-2015110498 | A1 * | 7/2015 | F01C 21/007 |

OTHER PUBLICATIONS

Japanese Patent Office issued an Office Action on Nov. 28, 2023 regarding parallel Japanese Patent Application No. 2022-197443, 6 pages.

* cited by examiner

SCREW SPINDLE PUMP

CROSS-REFERENCE TO RELATED APPLICATIONS

The present application claims priority of DE 10 2021 133 114.5, filed Dec. 14, 2021, the priority of this application is hereby claimed, and this application is incorporated herein by reference.

BACKGROUND OF THE INVENTION

The invention relates to a screw spindle pump, having a spindle housing, in which a drive spindle and at least one running spindle which meshes therewith are received in spindle bores, and an outer housing which encloses the spindle housing.

Such a screw spindle pump serves to deliver a fluid, for example fuel or a supply liquid or cooling liquid or the like, as are required in a motor vehicle. Such screw spindle pumps can also be used in other land vehicles or aircraft, such as e.g. aeroplanes or drones, the possible uses not being restricted thereto. The delivery takes place via at least two intermeshing spindles, namely a drive spindle, which is coupled to a drive motor, and a running spindle, which are both received in a spindle housing. For this purpose, the spindle housing has a plurality of intersecting spindle bores corresponding to the number of spindles. In addition, the spindle housing is received in an outer housing or pump housing via which the fluid to be delivered is supplied and removed.

The operating principle of the screw spindle pump is based on the drive spindle and the running spindle intermeshing by way of their spindle profiles and, owing to the rotation of the spindles, a delivery volume is displaced axially. For this purpose, the drive spindle has a cylindrical spindle core and generally two spindle profiles revolving around the spindle core. Said spindle profiles form revolving profile valleys in which corresponding spindle profiles of the running spindle engage, and vice versa. In addition to such a two-spindle configuration, it is also conceivable to design the screw spindle with three spindles, that is to say that then two running spindles are provided which are arranged offset by 180° next to the central drive spindle and mesh with the latter.

The fluid to be delivered is supplied to the screw spindle pump via an inlet which is provided on the suction side of the outer housing and is conventionally in the form of a connection fitting, while the pressurized fluid which is delivered is conveyed away on the pressure side via a corresponding outlet provided on the outer housing and likewise designed as a connection fitting. Corresponding lines of the fluid circuit, in which the screw spindle pump is connected, are to be connected to the inlet and the outlet, i.e. to the respective ports. A frequent occurrence here is that the line ends to be connected to the inlet and the outlet are provided at certain positions which are not flexible, for example because of the installation space situation, which in turn makes it necessary that, of course, the inlet port and the outlet port also have to be correspondingly positioned on the pump side in order to close the connections. This in turn requires the outer housing, on which the corresponding inlet and outlet ports are provided, to be correspondingly configured. The outer housing is regularly a, for example, pot-like, integral component, generally a cast component or injection molded component or a 3D printed part, on which the corresponding ports are integrally formed in a fixed position.

A varying connection geometry of the mounting surroundings consequently makes it necessary to keep different outer housings, into which the spindle housing is inserted, in stock for different mounting situations. This is expensive.

SUMMARY OF THE INVENTION

The invention is therefore based on the problem of specifying a screw spindle pump which is improved by contrast.

To solve this problem, according to the invention a screw spindle pump is provided, having a spindle housing, in which a drive spindle and at least one running spindle which meshes therewith are received in spindle bores, an outer housing which encloses the spindle housing, and a cover component which is placed axially onto the outer housing and on which both an axial fluid inlet port and a lateral fluid outlet port are provided, wherein the fluid inlet port communicates with a fluid inlet of the spindle housing and the fluid outlet port communicates with a fluid outlet of the spindle housing, wherein the cover component is fastenable to the outer housing in a plurality of marked rotational positions with a first pitch, and wherein the spindle housing is fastenable to the cover component and/or in the outer housing in a plurality of marked rotational positions with a second, smaller pitch.

The screw spindle pump according to the invention makes it particularly advantageously possible to be able to arrange the fluid inlet port and the fluid outlet port in different spatial positions, along with the possibility of arranging the spindle housing in the outer housing in a spatial orientation which is advantageous for the delivery process and in which, for example, the longitudinal axes of the spindles lie in a horizontal plane.

First of all, the outer housing is open on both axial sides. While the drive motor is placed onto the one axial side and closes the latter, which drive motor is coupled with a drive shaft via a coupling to the drive spindle for active driving thereof or of the spindle set, the other side of the outer housing is closed via a cover component. Both the fluid inlet port and the fluid outlet port are now provided on said cover component. The fluid inlet port is directed axially here while the fluid outlet port is directed to the side and is, for example, at an angle of 90° with respect to the inlet. That is to say that the cover component on the one hand closes the outer housing but on the other hand has the two connection points. No connection modifications whatsoever are provided on the outer housing itself, i.e. on the approximately virtually hollow-cylindrical component which is open on both sides, and therefore said outer housing can be designed relatively simply. This ultimately also applies to the cover component which is a relatively narrow component and, in particular if it is manufactured from plastic, can be easily equipped with the corresponding connection fittings.

In order to permit different spatial orientations of the lateral fluid outlet port (the fluid inlet port is, as described, positioned axially in or parallel to the pump longitudinal axis), the cover component is connectable to the outer housing in different defined rotational positions. Said marked defined rotational positions have a first pitch. That is to say that the cover component can be fastened to the outer housing in different defined positions rotated about the outer housing longitudinal axis. The result of this is that the laterally protruding fluid outlet port can thereby be inevitably brought into different circumferential positions.

In order, furthermore, also to create the possibility that the spindle housing and, with it, the spindles can be brought, in the mounted position of the pump, into a spatial position that is best possible for operation of the pump, a second rotational possibility is furthermore provided, i.e. consequently a second degree of rotational freedom. This is because, according to the invention, the spindle housing can also be fastened either to the cover component or to the outer housing or to both in different marked rotational positions. Said marked rotational positions with respect to the spindle housing have a second pitch, this pitch being smaller than the first pitch in which the cover component is fastenable. If, therefore, the spindle housing is intended always to be positioned in such a manner that the longitudinal axes of the spindles accommodated therein lie approximately in a horizontal plane, the spindle housing, with respect to the final mounted position, can be inserted into the outer housing in such a manner that it can take up a horizontal orientation.

Resulting from the fact that there are two different degrees of rotational freedom which each permit marked positionings of the cover component and of the spindle housing, the screw spindle pump affords a high degree of flexibility with respect to the positioning in particular of the radially or laterally protruding fluid outlet port. This is because, firstly, there is the possibility, by corresponding positioning of the cover component in a required rotational position, of undertaking a rough orientation of the laterally protruding fluid outlet port with respect to the mounted position. Then, by corresponding positioning of the spindle housing in a preferred rotational position in the outer housing or fastening of the spindle housing, resulting from the second, smaller pitch, a fine positioning, as it were, of the laterally protruding fluid outlet port can be undertaken. This is because the outer housing and the cover component are ultimately rotated together relative to the spindle housing which, as stated, is intended in the final mounted end position to be arranged, for example, horizontally with respect to the spindle axis plane. The final rotational position can then be effected such that the laterally protruding fluid outlet port is in a rotational or circumferential position into which it cannot be brought solely by rotation of the cover component relative to the outer housing and the fastening thereof to the outer housing.

The screw spindle pump according to the invention therefore affords the possibility firstly of very flexibly undertaking the spatial positioning of the laterally or radially protruding fluid outlet port in the circumferential direction, and, secondly, the possibility of arranging the spindle housing with the spindles so as to be appropriately spatially oriented for the best possible operation of the pump.

As described, the first and the second pitch differ, the second pitch being smaller than the first pitch. Preferably, the first pitch is 90° while the second pitch is 45°. This means that the cover component can be fastened to the outer housing in four marked positions, namely at 0°, 90°, 180° and 270°. By contrast, the spindle housing can be arranged and fastened in eight marked rotational positions relative to the outer housing or cover component, namely 0°, 45°, 90°, 135°, 180°, 225°, 270° and 315°. This means in turn that, in end effect, the fluid outlet port can likewise be arranged in eight marked final circumferential positions which correspond to the angular positions described with respect to the second pitch if it is assumed that the spindle housing is positioned in such a manner that the longitudinal axes of the spindle lie in a common horizontal plane. Since, of course, a certain slight tilting of the horizontal plane of the spindle axes is also possible without this having too much of a disadvantageous effect on the delivery operation, for example a tilting by a maximum of 10° to both sides, it inevitably follows that, of course, many more corresponding circumferential positions can be taken up by the fluid outlet port and, consequently, the latter can be optimally oriented with respect to the connection modification of the line to be connected.

In addition to the fact that the screw spindle pump is designed as a two spindle pump comprising just one drive spindle and a running spindle arranged parallel and laterally thereto, it is of course also possible to design the screw spindle pump as a three spindle pump, with a central drive spindle and two running spindles which are arranged laterally thereto on either side and are positioned offset by 180° and both mesh with the drive spindle.

The drive spindle and the one or the two running spindles could expediently be supported axially on the suction side, i.e. adjacent to the fluid inlet port. For this purpose, in a development of the invention, a support component is provided which is arranged on the cover and on which all of the spindles are supported axially or in relation to which they can run for axial support. Such a support is expediently also provided on the opposite side of the spindle housing; corresponding support means at least for the two running spindles can also be provided there since the drive spindle is ultimately supported axially on the drive shaft of the drive motor.

In a development of the invention, the support component provided on the suction side adjacent to the fluid inlet port is a feather key which, according to the invention, is positionable on the cover component in different marked rotational positions with the second pitch. That is to say that said feather key migrates as it were together with the spindle housing and consequently, if the spindle housing, as described, is intended to be oriented horizontally, for example, is likewise oriented horizontally. This variable arrangement of the feather key consequently always ensures optimum support of the spindle towards the suction side.

Preferably, receiving grooves, into which the elongate feather key can be inserted, are provided on the cover component in a manner corresponding to the various rotational positions. Said elongate grooves are arranged in a star shape, with one receiving groove always being positioned horizontally or approximately horizontally depending on the orientation of the cover. Since said grooves, as described, are positioned in accordance with the second pitch, in which the spindle housing can also be arranged, feather key and spindle housing or spindles are accordingly always in an equivalent position or orientation.

Preferably, the feather key is fixed in the respective receiving groove by clamping, that is to say that the feather key is slightly larger than the size of the feather key, and therefore clamping fixing, which may also be a snap-action fixing, is ensured.

As described, the spindle housing can be fixed either only or at least additionally also on the cover component in the plurality of rotational positions corresponding to the second pitch. In order to permit this fixing, a plurality of first fastening means which are positioned in a manner corresponding to the second pitch are provided on the cover component, said fastening means being connectable to second fastening means provided on the spindle housing. That is to say that first and second fastening means which interact with one another only in the corresponding rotational positions and permit an in particular rotationally secured fastening of the spindle housing to the cover component are provided both on the cover component side and on the spindle housing side.

In one specific realization form, the first fastening means can be depressions which are formed on the cover component and in which axial protrusions, which are provided on the spindle housing as second fastening means, engage. That is to say that ultimately a depression geometry corresponding to the second pitch is formed on the cover housing. If, for example, two axial protrusions provided about 180° are provided on the spindle housing as the second fastening means, in each case two depressions offset by 180° with respect to each other are likewise provided in the respective pitch on the cover component, but in each case two in each defined rotational position, that is to say a total of eight pairs of depressions at a 45° pitch. By axial engagement of the protrusions in the depressions, a rotationally secure, form-fitting connection is readily possible. On the other side, the spindle housing is, of course, likewise correspondingly supported axially, for example at a corresponding stop on the outer housing or at a stop on the motor housing or an intermediate plate or the like.

Alternatively, it is conceivable also to arrange the first and second fastening means the other way around. That is to say that a plurality of axial protrusions are provided on the cover component as first fastening means, said protrusions each being arranged or integrally formed on the cover component in pairs and opposite one another offset by 180° in the corresponding defined rotational positions. In this case, the second fastening means are axial depressions which are provided on the end face of the spindle housing and are positioned offset from one another by 180° and in which in each case two protrusions on the cover component side engage.

As already described, the fastening of the spindle housing to the cover component is a fastening variant. Alternatively, it is also conceivable for the spindle housing to be fastenable to the outer housing in the corresponding marked rotational positions of the second pitch. For this purpose, it is conceivable to provide a plurality of first fastening means positioned corresponding to the second pitch on or in the outer housing, said fastening means being connectable to second fastening means provided on the spindle housing. That is to say that corresponding first and second fastening means, which interact with one another for the rotationally secured fixing, are also provided with respect to said connecting plane.

It is conceivable here that the first fastening means are radially open receptacles in which radially directed protrusions which are provided on the spindle housing and serve as second fastening means engage. That is to say that ultimately a type of tongue and groove configuration is provided, with corresponding grooves on the outer side of the spindle housing and corresponding tongues on the inner side of the outer housing. The tongues can be pushed axially into the grooves, via which the rotationally secure fastening takes place. Of course, it is also conceivable to form the fastening means the other way around, that is to say that the first fastening means are radially directed protrusions which engage in radially open receptacles which are provided on the spindle housing and serve as second fastening means.

In principle, there is, of course, the possibility of producing the spindle housing, the outer housing and/or the cover component from metal. Alternatively thereto, however, it is also conceivable to form the spindle housing, the outer housing and/or the cover component from plastic, i.e. to form them as corresponding injection molded components or 3D printed components. If a corresponding support component, for example the feather key, is provided, it is preferably made from metal, like the spindles, but they can basically also be manufactured from plastic.

In order to be able to correspondingly seal the pump interior and avoid leakage, the cover component is expediently sealed in relation to the spindle housing via a first sealing element and in relation to the outer housing via a second sealing element. For this purpose, a first axial receiving groove, into which the first sealing element is placed, can be provided on the cover component or on the spindle housing, while a second radial receiving groove, into which the second sealing element is placed, is provided on the outer housing or on the cover component. Therefore, firstly, there is axial sealing between spindle housing and cover component and, secondly, radial sealing between outer housing and cover component, the cover component expediently radially embracing the outer housing in said sealing region.

An expedient development of the invention makes provision that the spindle housing has an axial fluid outlet for the fluid which is delivered through the spindle housing via the drive spindle and the running spindle and which communicates with a fluid chamber which is formed between the spindle housing and the outer housing, extends around 360° and, in turn, communicates with the radial fluid outlet of the cover component. According to this refinement of the invention, the pressurized fluid leaves the spindle housing axially, i.e. in the longitudinal direction of the spindle longitudinal axes. This is expedient in order to reduce or to avoid annoying flow noises. Furthermore, this refinement makes provision that the pressurized fluid is then conducted into a fluid chamber which is formed between the spindle housing and the outer housing and which extends by 360° around the spindle housing. During the operation, this fluid chamber is filled with the fluid which is at the pump pressure or starting pressure. The result of this is that the fluid exerts a radially inwardly directed pressure on the spindle housing. This has the particular advantage that the spindle housing is thereby, as seen radially, pretensioned, and therefore said fluid pressure is able to counteract any geometry changes of the spindle housing or tolerances resulting from the operation of the pump or the internal pressure in the spindle housing. Consequently, there is in no case a small expansion of the spindle housing, which would have a disadvantageous effect on the efficiency. Instead, a pressure jacket is formed around the spindle housing by means of said fluid chamber, which may also be referred to as a pressure chamber.

Said fluid chamber, as seen axially, is intended to extend here over at least half of the length of the spindle bore or of the spindle housing such that a corresponding large overlap is provided and the radial pretensioning is provided over as large an area as possible. A chamber length which extends over approx. ⅔ of the spindle housing or over the entire length of the spindle housing is readily conceivable.

Furthermore, an intermediate component can be provided which is placed axially onto the outer housing and which is designed for connection of a drive motor, wherein one or more deflection cavities deflecting the fluid coming from the fluid outlet to the fluid chamber are provided on the intermediate component. Said intermediate component as it were forms the mounting interface for the drive motor or the motor housing and is arranged, preferably in the form of a plate, between the motor housing and the outer housing. A bore through which the drive shaft of the drive motor is guided towards the drive spindle is provided on said intermediate component. Said bore can also serve at the same time as a shaft bearing. A shaft sealing ring can be provided in the bore and can be used there for sealing purposes such that no fluid which is delivered can penetrate into the motor. The motor is therefore designed as a dry-running rotor. If no shaft sealing ring is provided there, a certain portion of the fluid can flow axially along the drive shaft into the motor for cooling same and can recirculate again, with the motor then being designed as a wet-running rotor.

Independently thereof, on the intermediate component which forms the axial end of the interior of the outer housing on the pressure side, one or more deflection cavities are provided there which make it possible to guide the fluid flowing axially out of the spindle housing firstly radially outwards and secondly, as seen axially, back into the fluid chamber surrounding the spindle housing. The fluid then passes from said fluid chamber into the region of the cover-side fluid outlet port; i.e. it communicates with the latter with the fluid then being removed.

As an alternative to the integration of such an intermediate component, it is, of course, also conceivable to place the motor housing directly onto the outer housing, i.e. to connect the two directly to each other. In this case, a corresponding base plate of the motor, through which the drive shaft is guided, would form the axial end of the interior of the outer housing and consequently of the pump interior. A shaft sealing ring can in turn be provided, or an axial throughflow of the fluid for cooling the motor can be possible. In each case, in this variant of the invention, the base plate of the motor housing has the one or more deflection cavities since it, as stated, forms the axial housing end.

Expediently, only one deflection cavity is provided which is designed as an annular groove or pot-like depression which has a round configuration in the region of the groove base or depression base. The pressurized fluid flows into the groove or depression and, on the one hand, is guided radially outwards via the round groove or depression geometry, but on the other hand is also guided axially back into the fluid chamber. This round configuration or the avoiding of corners or edges in turn takes into account the pump operation being as quiet as possible since no flow noises arise even in the deflection region.

In addition to the screw spindle pump itself, the invention furthermore relates to the use of such a screw spindle pump in a motor vehicle for delivering an operating liquid. In the case of such a use, the screw spindle pump can be used for different purposes. It can firstly serve to correspondingly deliver cleaning liquid, for example a windscreen wiper liquid. It is preferably used as a coolant pump, i.e. delivers a coolant. The coolant can be any desired fluid coolant. In this connection, in particular the delivery of a coolant for cooling an energy store is paramount. Modern electrically operated motor vehicles have a correspondingly dimensioned energy store, i.e. a correspondingly dimensioned traction battery, which is heated during the operation and has to be correspondingly cooled. It therefore has to be supplied with a corresponding coolant, which is readily possible through the use of the screw spindle pump according to the invention since the screw spindle pump is capable of circulating a high delivery amount at a correspondingly high pressure.

The various features of novelty which characterize the invention are pointed out with particularity in the claims annexed to and forming a part of the disclosure. For a better understanding of the invention, its operating advantages, specific objects attained by its use, reference should be had to the drawings and descriptive matter in which there are illustrated and described preferred embodiments of the invention.

DETAILED DESCRIPTION OF THE INVENTION

Figure 1:
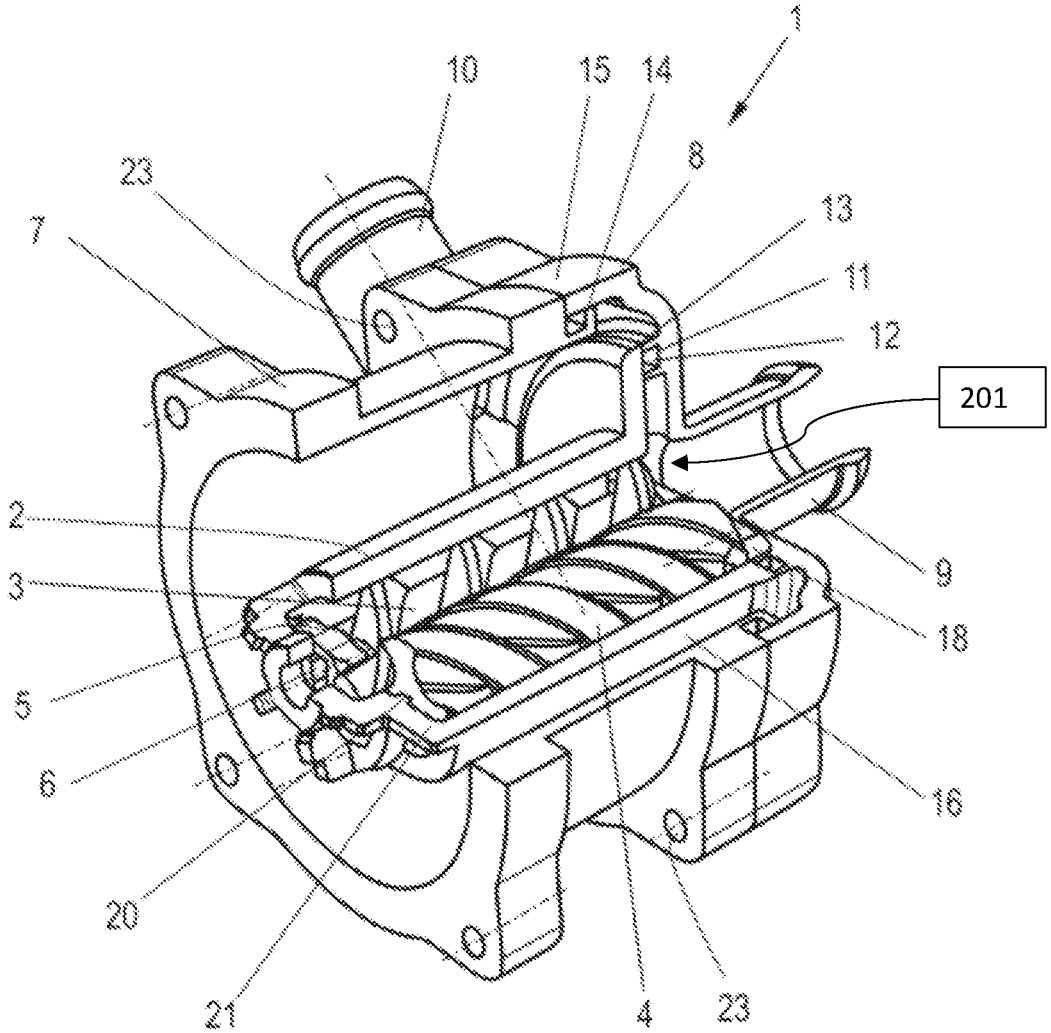
FIG. 1 shows a screw spindle pump according to the invention in a partially sectioned perspective view without a drive motor inserted.

FIG. 1 shows a screw spindle pump 1 according to the invention, having a spindle housing 2, in which, in the exemplary embodiment shown, two spindles, namely a drive spindle 3 with a spindle profile and a running spindle 4 with a spindle profile are received. The two spindle profiles or spindles intermesh in a manner known per se. This spindle set is driven via the drive spindle 3 which is coupled to a drive motor, not shown specifically here, or to the drive shaft thereof. For this purpose, use is made of a coupling element 5 with an insertion receptacle 6 for a coupling pin of the drive shaft, wherein the coupling element 5 is coupled to the drive spindle 3 for rotation therewith. The drive motor is placed onto or at an outer housing 7 and screwed thereto, with the virtually hollow-cylindrical outer housing 7, as FIG. 1 shows, completely accommodating the spindle housing 2. The outer housing 7 is closed on this side, as seen axially, via the drive motor, not shown specifically, or the motor housing. On the opposite side, a cover component 8 is placed axially onto the outer housing 7 and closes the outer housing 7 and therefore the pump interior on this side. The cover component 8, preferably a plastics component, has an axial fluid inlet port 9 that communicates with a fluid inlet 201 of the spindle housing, that is to say that the fluid which is to be delivered is sucked up axially or introduced on said suction side. It furthermore has a fluid outlet port 10 which protrudes laterally towards the side, i.e. rotated here by 90° with respect to the fluid inlet port 9, via which the pressurized fluid is removed towards the side.

In the manner in which the connection between the outer housing 7 and the drive motor or the motor housing is obviously correspondingly sealed via one or more sealing elements, the connection of the cover component 8 is also sealed with respect to the outer housing 7 and with respect to the spindle housing 2. For this purpose, the cover component 8 is provided with an annular flange 11 with an axial receiving groove 12 in which a first sealing element, which is not shown specifically here, can be arranged. Said sealing element provides an axial seal towards an annular flange 13 of the spindle housing 2. The sealing with respect to the outer housing 7 likewise takes place via a sealing means, not shown specifically, which is received in a radially open receiving groove 14 formed on the outer housing 7, said receiving groove 14 being embraced radially by a flange 15 of the cover component 8. In this way, complete sealing, on the one hand, of the outer housing 7 is achieved, but on the other hand, also of the spindle space, and therefore the pressurized volume can no longer flow back into the suction region.

Figure 3:
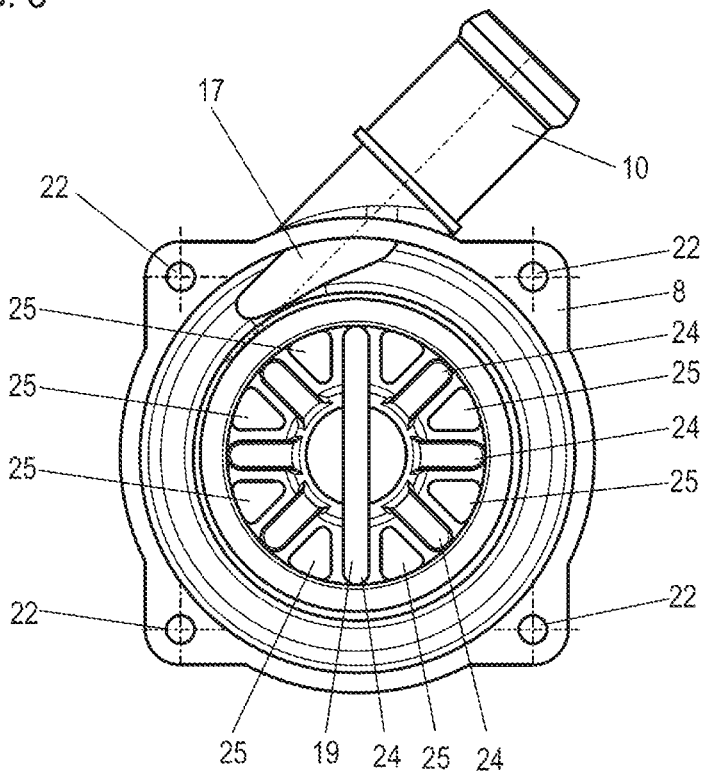
FIG. 3 shows a view of the inner side of the cover component from FIG. 2.

Between the spindle housing 2 and the outer housing 7 there is formed a fluid chamber 16 which embraces the spindle housing 2 around 360° and into which the fluid emerging axially out of the spindle housing 2, i.e. flowing out in the direction of the drive motor, is deflected and enters. That is to say that the fluid outlet on the spindle housing side communicates with the fluid chamber 16. The fluid chamber 16 for its part communicates again with the fluid outlet port 10, for which purpose a corresponding opening 17 is provided on the cover component 8, as shown in FIG. 3. This opening 17 is open towards the fluid chamber 16. The fluid which is already pressurized is present in the fluid chamber 16, and therefore the fluid can exert a corresponding pressure circumferentially on the spindle housing 2, which is manufactured, for example, from plastic, the pressure counteracting a possible change in geometry of the spindle housing 2.

The two spindles 3, 4 are supported axially on the suction side, i.e. on the cover component 8, via a support component 18, here a feather key 19 (see FIG. 3), such that a defined abutment is formed here. In the opposite direction, the drive spindle 3, on the one hand, is supported on the drive shaft, the running spindle 4, on the other hand, is axially supported on a corresponding support element 20 which is integrally formed here on a corresponding web 21 of the spindle housing 2. Furthermore, on said web 21, the bearing for the drive shaft is provided or, if the spindle housing is made from plastic, is directly integrally formed thereon. The bearing receiving the drive shaft is exactly aligned with the central axis of the spindle bore receiving the drive spindle, and therefore no tolerances are provided between the drive shaft mounting and the spindle axis and therefore within the coupling of the two components. Consequently, no imbalances are provided, and a very quiet and noise-free movement of the spindles is thereby achieved.

Figure 2:
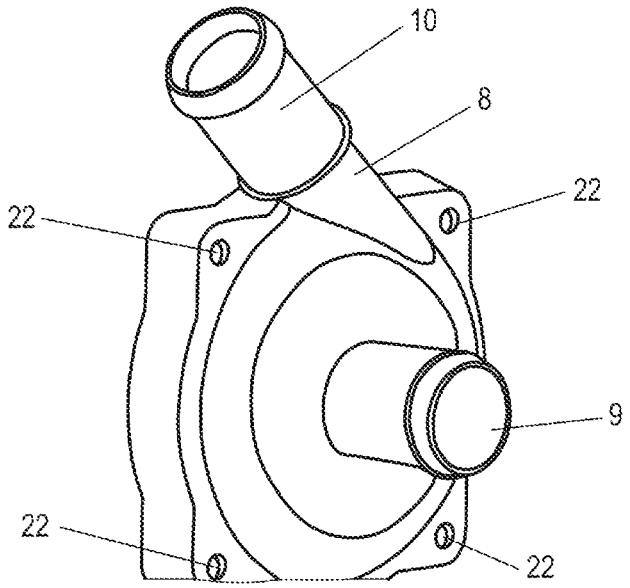
FIG. 2 shows a perspective view of the cover component.

FIGS. 2 and 3 show the cover component 8 in various views. FIG. 2 shows a perspective view of the outer side, with the central axial fluid inlet port 9 and the fluid outlet port 10, which protrudes to the side and runs here virtually tangentially, being shown here. Corresponding apertures 22 are provided in the four corners of the cover component 18, which is virtually square starting from the base, through which apertures corresponding fastening screws are guided and are screwed into corresponding internally threaded bores 23 which are provided on the outer housing 7. The bores 22 and the internally threaded bores 23 are positioned with a first pitch, a 90° pitch. That is to say that the cover component 8 can be fastened to the outer housing 7, provided that the latter remains in its position, in four marked rotational positions, namely in a 0°, 90°, 180° and 270° position. Accordingly, the fluid outlet port 10, as seen from the outer side, protrudes either obliquely upwards to the left, obliquely upwards to the right, obliquely downwards to the right or obliquely downwards to the left, while the axial fluid inlet port remains centrally in its position. That is to say that, by means of this configuration resulting from the fact that both the fluid inlet port 9 and the fluid outlet port 10 are arranged on the one cover component 8, basically four marked rotational positions of the cover component 8 and therefore also of the fluid outlet port 10 are provided.

Sometimes, however, because of the peripheral connection geometry with respect to the fluid outlet port 10, the latter also has to be brought into intermediate positions, i.e. other positions, than can be realized solely by rotating the cover component. In order to realize this, it is possible to bring the spindle housing 2 together with a spindle 3, 4 into various rotational positions relative to the outer housing 7 and the cover component 8, with said marked defined rotational positions being arranged in accordance with a second pitch. This second pitch is a 45° pitch. It is the aim here for the spindle housing 2 and, along with it, its two spindles 3, 4 (the same naturally also applies in the case of a three spindle design) to always remain in the same basic position, i.e., for example, positioned horizontally, and therefore the two spindles lie horizontally in a plane or the spindle longitudinal axes lie in a common horizontal plane. That is to say that the outer housing 7 can be rotated virtually in 45° steps about the spindle housing 2, together with the cover component 8, which is fastened to it, but, of course, the cover component 8 in turn can be fastened to the outer housing 7 in the above-described four defined rotational positions. This makes it possible for the fluid outlet port 10 which protrudes here to the side to be able to be positioned in a total of eight different defined spatial positions or circumferential positions, namely at 0°, 45°, 90°, 135°, 180°, 225°, 270° and 315°. This makes it possible to be able to position the fluid outlet port 10 optimally with respect to the connection periphery (the fluid inlet port 9 remains, as described, fixed axially in position), while at the same time it is ensured that the spindle housing 2 and, along with it, the spindle set is always arranged in the best possible spatial orientation for the operation of the pump, namely horizontally here.

In order to make this possible, firstly the axial support of the spindles 3, 4 has to be ensured in every rotational position, as does the corresponding fixing of the spindle housing 2 relative to the outer housing 7 and to the cover component 8.

For this purpose, FIG. 3 shows the possibility of how the feather key 19 can be arranged on the cover component 8 in a manner corresponding to the rotation, the feather key having to be fixed in different positions in the cover component 8 when the cover component 8 is rotated, if the spindle set is intended to remain horizontal. For this purpose, four receiving grooves 24 into which the elongate feather key 19 can be placed are provided on the cover component 8 virtually in a star-shaped arrangement, with the feather key 19 being expediently fixed by clamping in the receiving grooves 24. The four receiving grooves 24 are arranged in a 45° pitch, i.e. their pitch corresponds to the second pitch in which the spindle housing 2 can also be arranged. That is to say that the feather key can be rotated about the central axis in 45° steps, or the cover component 8, with the feather key 19 arranged in a fixed position, can be rotated in 45° steps relative to the feather key 19.

Furthermore, a plurality of depressions 25 which are formed on the inner wall surface of the cover component 8 are provided, the depressions 25 being arranged between the corresponding groove portions likewise in a manner corresponding to the second pitch, i.e. in 45° steps. Accordingly, eight depressions 25 are provided offset equidistantly in the circumferential direction. Said depressions 25 serve for receiving corresponding axial protrusions which are formed on the spindle housing 2 and which therefore engage in the depressions 25, via which the rotational securing and fixing in position take place.

Figure 4:
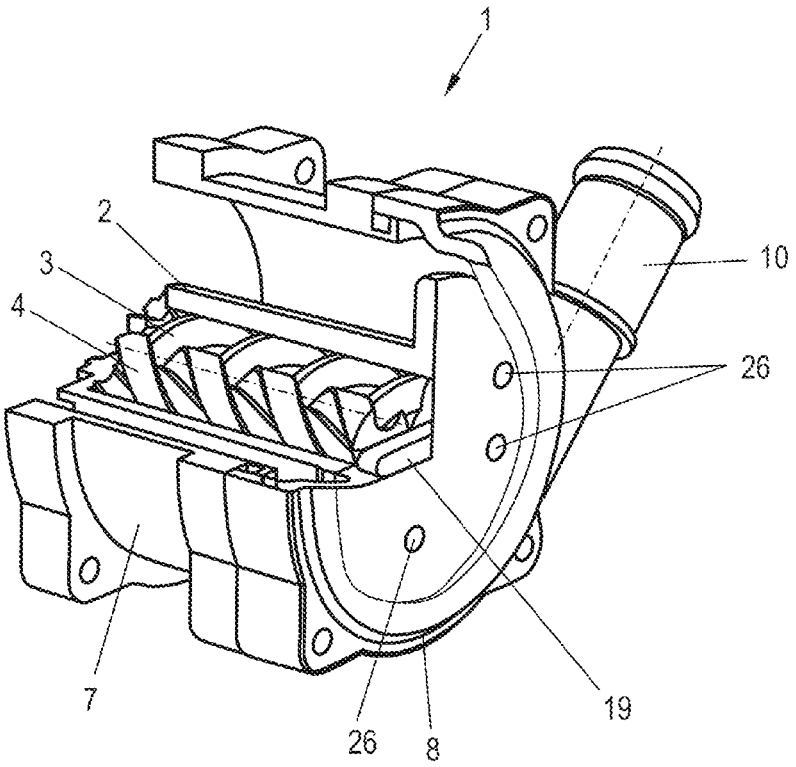
FIG. 4 shows a perspective view of the screw spindle pump from FIG. 1 from the other side with the cover component partially sectioned.
Figure 5:
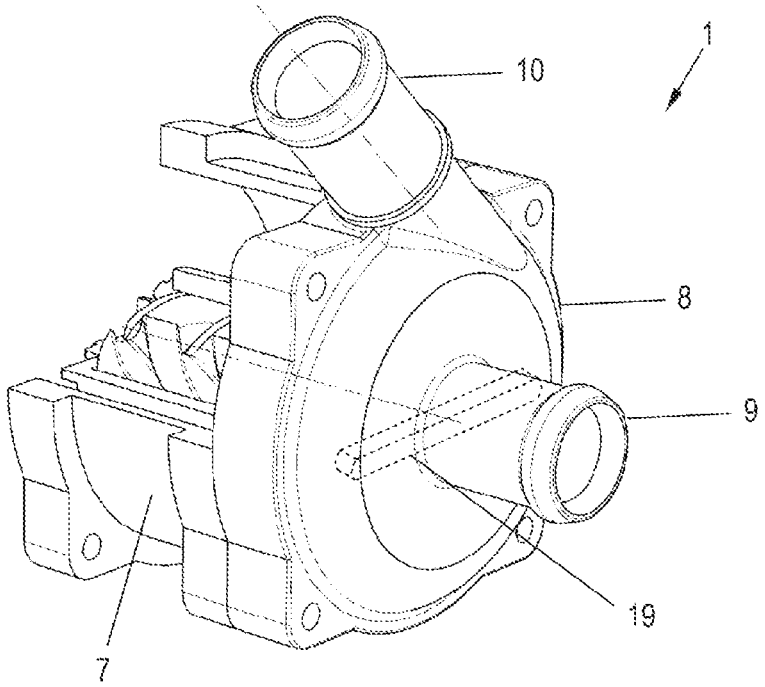
FIG. 5 shows the screw spindle pump from FIG. 4 with the complete cover component rotated by 90°.

FIGS. 4 and 5 show two corresponding arrangement examples, wherein the outer housing 7 remains in its position, but the cover component 8 is positioned rotated by 90°, as seen anticlockwise, between FIG. 4 and FIG. 5. In order to be able to illustrate the position of the feather key 19 in the respective arrangement, the cover component 8 is illustrated partially open in FIG. 4. Actually, it is of course closed axially apart from the fluid inlet 9. In FIG. 5, the feather key is indicated by dashed lines.

In FIG. 4, the fluid outlet port 10 is shown protruding upwards to the right. The feather key 19 is in a first receiving groove 24. The spindle housing 2 together with the drive spindle 3 and the running spindle 4 is in a horizontal arrangement and also remains in said arrangement. The axially extending protrusions 26 which are provided on the radial flange 13 of the spindle housing 2 and of which, for example, only four may be provided, or else eight, corresponding to the number of depressions 25, are shown. In the mounted position, each axial protrusion 26 engages in a depression 25, and therefore virtually a form fit is produced there or the cylindrical protrusions 26 lie against the corresponding lateral walls of the depressions 25. A rotationally secured connection of the spindle housing 2 to the cover component 8 is thereby provided.

FIG. 5 shows the screw spindle pump 1 from FIG. 4, the cover component being rotated 90° to the left here. The fluid outlet port 10 protrudes upwards to the left. The feather key 19 is received in a second receiving groove 24 which is offset by 90° with respect to the receiving groove 24 in which the feather key 19 was received in the case of the arrangement according to FIG. 4. The axial protrusions 26 engage in turn in corresponding depressions 25, but in the respective depression 25 which is offset by 90° with respect to the arrangement according to FIG. 4. By means of said adaptability of the axial support via the adjustable feather key 19 and the possibility of permitting a rotationally secured fastening of the spindle housing 2 in every rotational position, it is therefore easily possible to realize the four different positions of the cover element 8.

Figure 6:
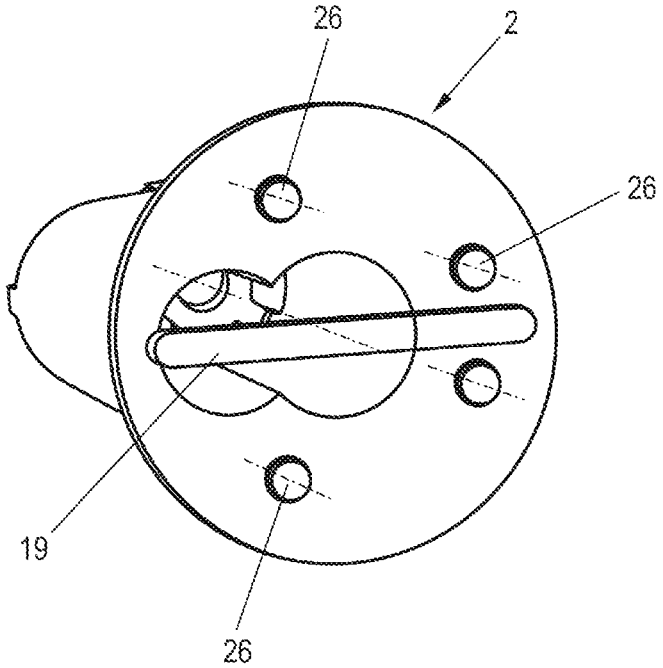
FIG. 6 shows a perspective view of the spindle housing to illustrate the protrusions.

FIG. 6 shows, in a perspective view, the spindle housing 2 and the feather key 19. The spindle housing 2 has an axially extending portion, in which the spindle bores are formed, and a terminal and radial extending flange portion, on which the protrusions 26 are provided, as FIG. 6 clearly shows. Four protrusions 26 are provided which are positioned at the arrangement angle corresponding to the pitch of the depressions 25 on the cover component 8. These protrusions 26 engage, as described, in the depressions 25.

FIGS. 7-14 furthermore show the possibility of also being able to set intermediate positions between the four marked cover component positions. This is possible since the combination of outer housing 7 and cover component 8 can be rotated in 45° steps about the positionally fixed spindle component 2. At the same time, the feather key 19 migrates, as described, in the corresponding 45° steps, and also, of course, the spindle housing 2 is in turn fixed in position in each 45° position via the corresponding engagement of the axial protrusions 26 in the depressions 25.

A view of the inner side of the cover component 8 with an illustration of the feather key 19 and, in dashed lines, the spindles 3, 4, which are axially supported on the feather key 19, is in each case shown here. These views very clearly illustrate the stepwise rotation of the cover component 8 relative to the spindle housing 2 and the spindles 3, 4 and the repositioning of the feather key 19, and also that the spindles can remain in their preferred position despite the change in the connection position. As described above, the outer housing 7, which is not shown here for clarity reasons, also of course rotates at the same time.

Figure 7:
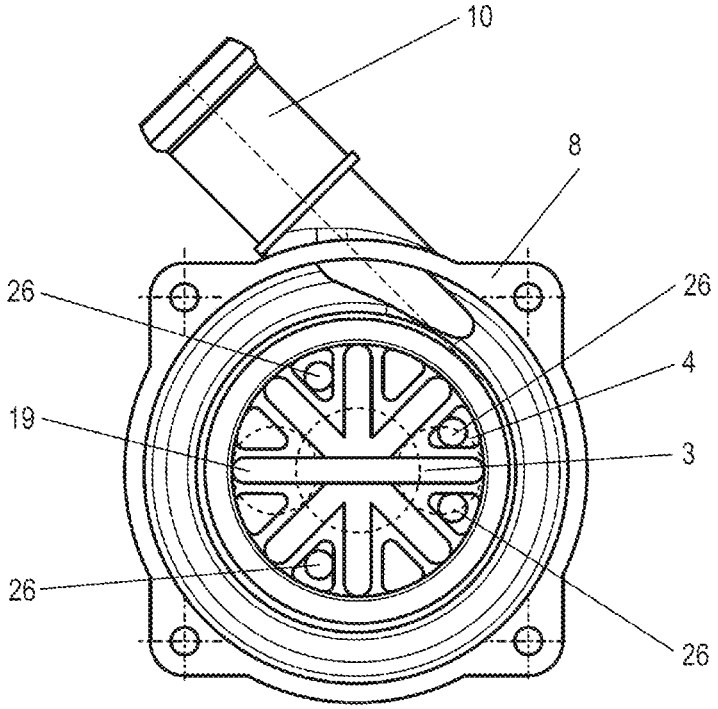
FIGS. 7-14 show various partial views of the screw spindle pump according to the invention with partially sectioned to illustrate the different positioning possibilities of the fluid outlet port.

FIG. 7 shows the starting situation as has already been described in FIG. 5. The cover component 8 is shown here only schematically and the drive spindle 3 and the running spindle 4, which are supported axially on the feather key 19, are indicated.

Figure 8:
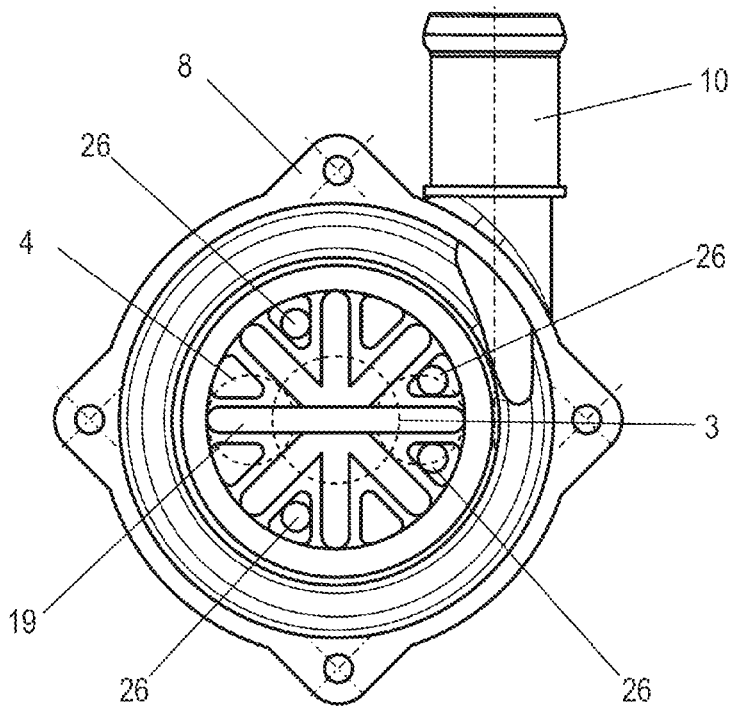

FIG. 8 shows the arrangement in which the fluid outlet port 10 is directed vertically upwards. In this arrangement, the outer housing 7 together with the cover component 8 is positioned by 45° relative to the spindle housing 2 or the spindle 3, 4, which always remains in the horizontal orientation. This is made possible by the feather key 19 being inserted by 45° into the next following receiving groove 24 and the cover component 8 together with the outer housing 7 being rotated by 45° around the spindle housing 2. Within the scope of the mounting of the cover component 8, the protrusions 26 engage in the depressions 25, which are offset by 45° with respect to the situation according to FIG. 7, and therefore they are fixed in the 45° position.

Figure 9:
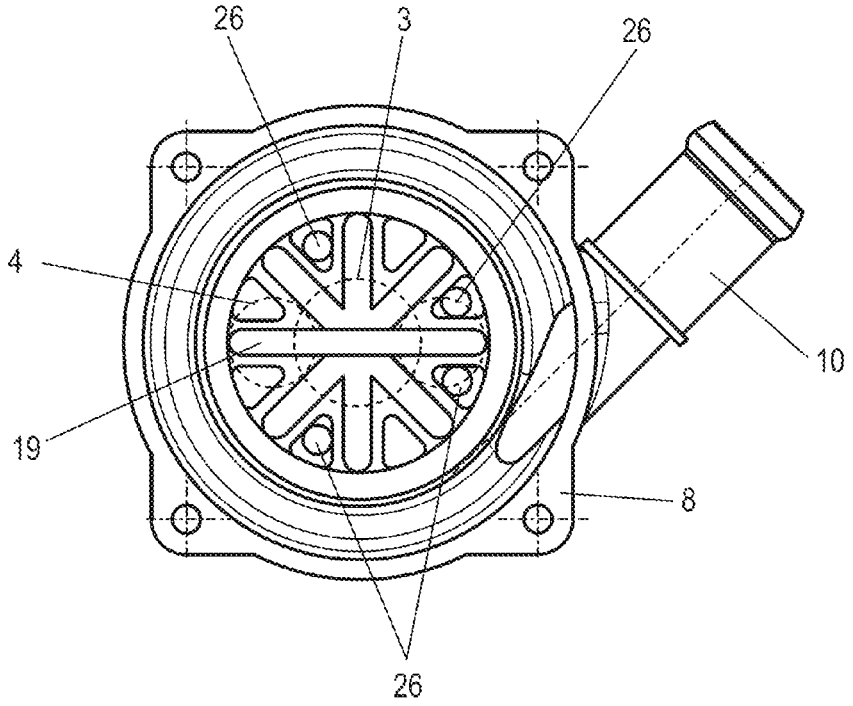

FIG. 9 shows the situation in which the cover component 8 is rotated by a further 45°. Starting from the mounting situation according to FIG. 7, this situation can easily be taken up by the fact that the outer housing 7 remains in the starting position according to FIG. 7, but the cover component 8 is rotated by 90° and at the same time the feather key 19 is also inserted by 90° into the next but one receiving groove 24. The spindles 3, 4 remain in their horizontal orientation, as already described. That is to say that ultimately the outer housing 7 has to be rotated by 45° only into each intermediate position between two marked rotational positions of the first pitch.

Figure 10:
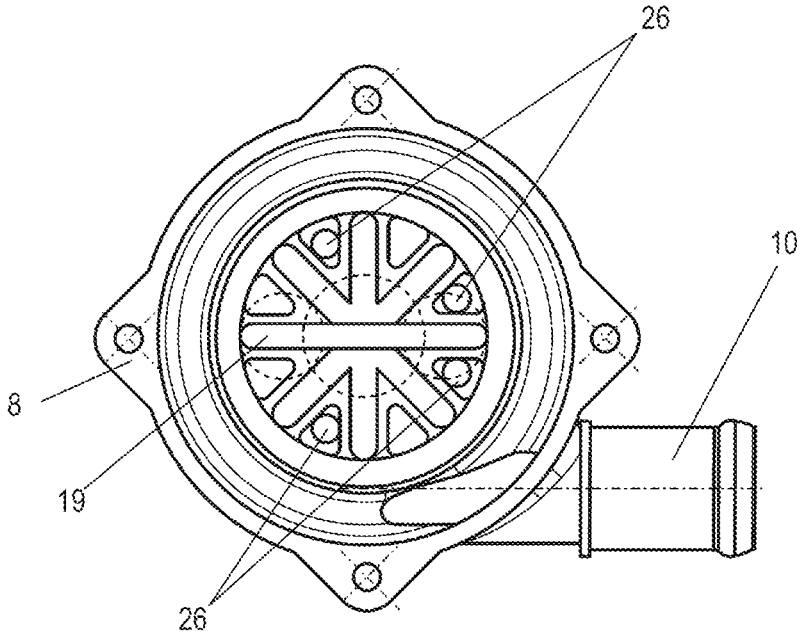

FIG. 10 shows the cover component 8 rotated by a further 45° starting from the arrangement from FIG. 9. Again, the outer housing 7 together with the cover component 8 is rotated here by 45° relative to the spindle set while simultaneously moving the feather key 19 by a further 45° into the next following receiving groove 24.

Figure 11:
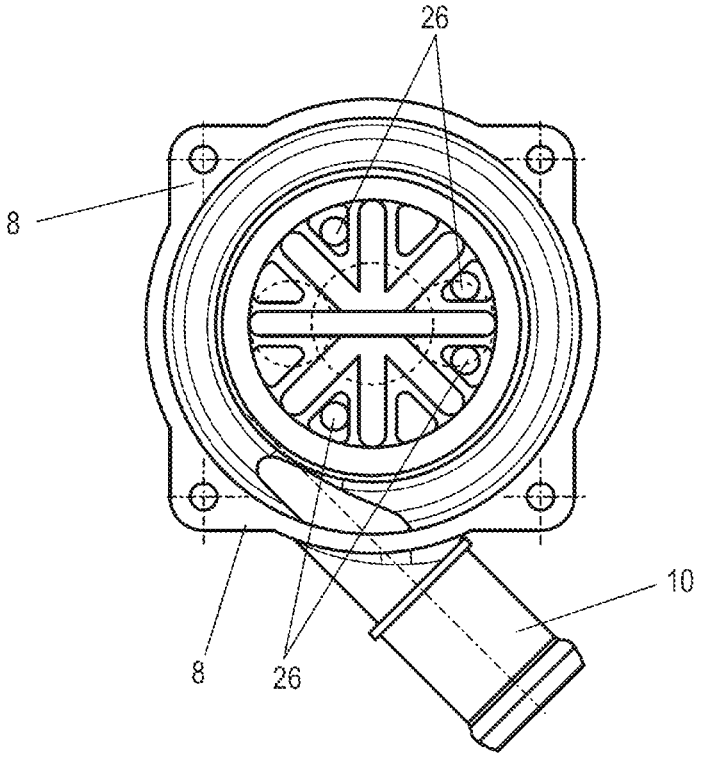

The situation according to FIG. 11 ultimately corresponds to that of FIG. 7, but the cover component 8 is positioned here rotated by 180°. Starting from the situation according to FIG. 7, it does not appear to be necessary to move the feather key 19.

Figure 12:
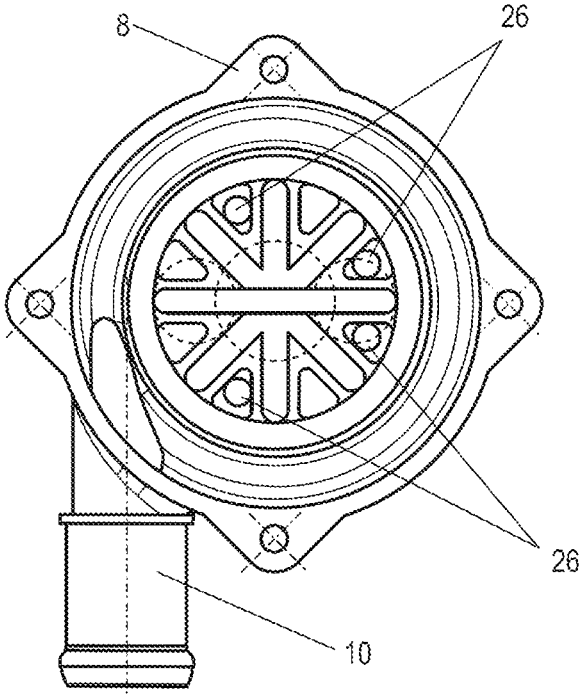
Figure 13:
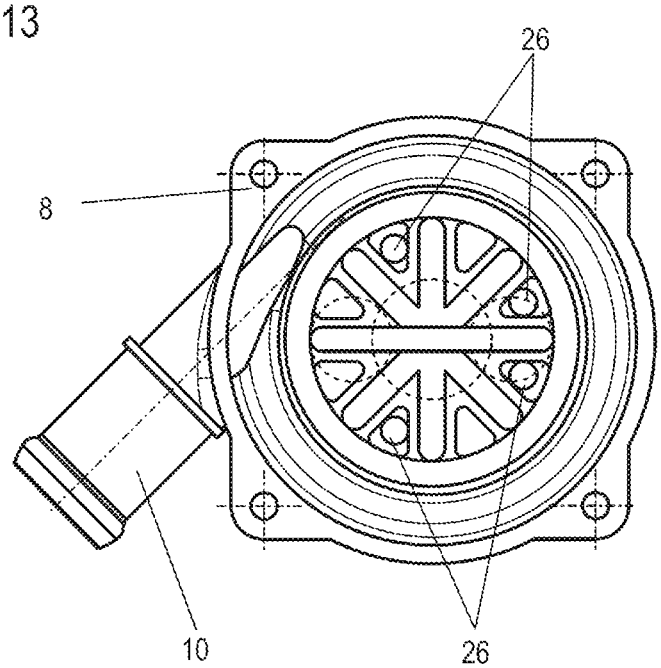
Figure 14:
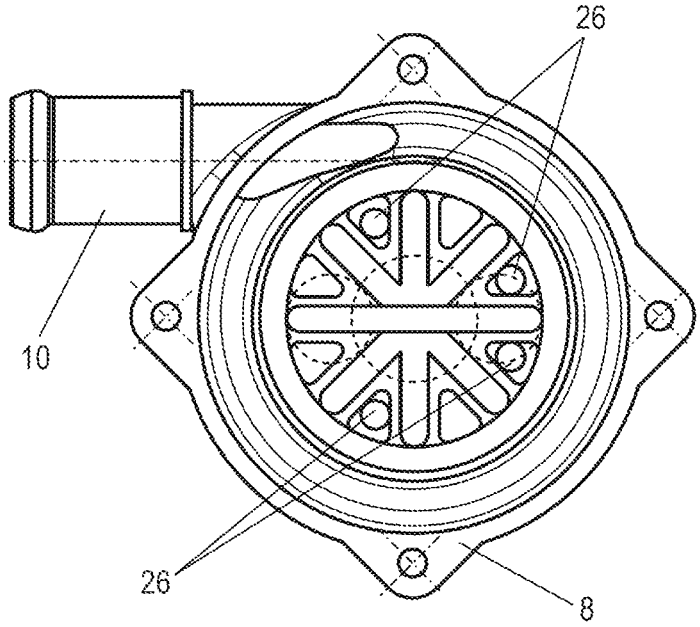

The arrangements of the modifications shown in FIGS. 12, 13 and 14 are produced in accordance with the above-described procedure or in accordance with the arrangement of the components involved.

Overall, it is therefore possible to bring the fluid outlet port 10 into eight defined circumferential positions, with it being simultaneously ensured that the spindle housing 2 or the spindles 3, 4 remain in the best possible spatial orientation. Since a certain tolerance range is also provided in this regard and, for example, the plane in which the longitudinal axes of the spindles 3, 4 jointly lie, can also be tilted slightly relative to the horizontal plane, each of the arrangements shown in FIGS. 7-14 are also provided with a certain tolerance range in the circumferential direction, for example +/−5° or +/−10°, such that an even more variable possibility of orientation with respect to the fluid outlet port 10 is provided.

Of course, there is the possibility of also reversing the two fastening variants per se. it would thus be conceivable to integrally form corresponding axial protrusions 26 on the cover component 8, while axial depressions 25 are formed on the spindle housing 2.

Figure 15:
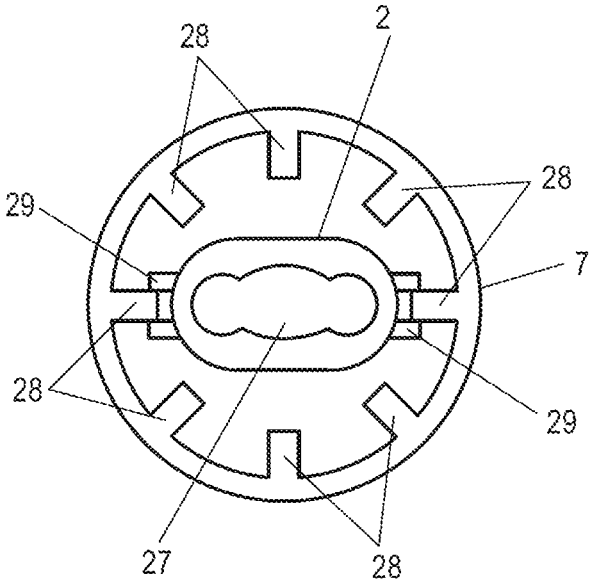
FIG. 15 shows a schematic illustration of the possibility of fastening the spindle housing in the outer housing.

As described above, the spindle housing 2 is fixed in the different rotational positions on the cover component 8 by the engagement of the axial protrusions 26 in the corresponding depressions 25. As an alternative to this rotational securing or fixing, it is also conceivable to connect the outer housing 7 to the spindle housing 2 in the corresponding 45° rotational positions. A schematic illustration of such a possibility is shown in FIG. 15. The outer housing 7 and the spindle housing 2 with its spindle bores 27, which intersect one another, is shown here purely schematically. By way of example, three intersecting spindle bores are shown here, that is to say that a three-spindle screw spindle pump 1 is illustrated here. On the inner circumference of the outer housing 7, which here is basically cylindrical on the inside, a plurality of radially inwardly projecting protrusions 28 are provided in accordance with the second 45° pitch, i.e., overall, in the case of a 45° pitch, eight such protrusions 28. Two receiving grooves 29 lying opposite each other by 180° and each receiving a protrusion 28 in the respective mounted position are provided on the outer side of the spindle housing 2. If the spindle housing 2 is placed into the outer housing 7, when the axial end position is reached, two protrusions 28 lying opposite each other by 180° are introduced here into the receiving grooves 29, with the fixing and rotational securing thereby being realized. This is therefore a tongue and groove arrangement. A longer engagement, as seen axially, does not have to be provided here after the spindle housing 2 or the spindles 3, 4 are supported axially towards both sides.

Equally, it is alternatively conceivable to provide corresponding receiving grooves 29 on the inner circumference of the outer housing 7, while two protrusions 28 are formed on the outer side of the spindle housing 2.

Figure 16:
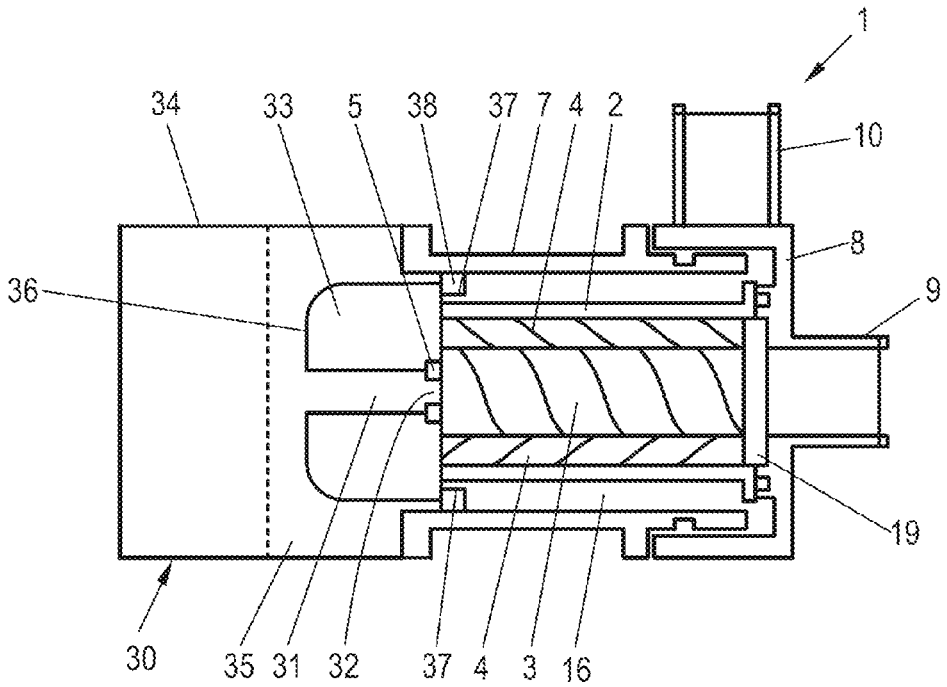
FIG. 16 shows a schematic illustration of a screw spindle pump according to the invention with the drive motor attached in order to illustrate the fluid chamber.

FIG. 16 finally shows a further configuration of a screw spindle pump 1, in which a drive motor 30 is attached to the outer housing 7 and is fastened there. This takes place via screw connections, not shown specifically, which pass through corresponding bores and engage in internally threaded bores on the opposite component. Otherwise, the screw spindle pump 1 in turn has a cover component 8 on which the fluid inlet port 9 and the fluid outlet port 10, which protrudes to the side, radially or tangentially, is provided. The spindle housing 2 is also shown in which the central drive spindle 3 and two lateral running spindles 4, which are illustrated vertically one above the other here for clarity reasons, are accommodated. As described, the spindles 3, 4 mesh together. The drive spindle 4 is connected here to the drive motor 30 via a motor-side drive shaft 31 which engages with an insertion pin 32 into the coupling element 5 which has already been described and is coupled to the drive spindle 3 for rotation therewith. The drive spindle 3 is thereby supported axially. The running spindles 4 are axially supported in a manner not shown specifically but already described with respect to FIG. 1. The feather key 19 for axially supporting all three spindles 3, 4 is found in turn on the opposite suction side.

Furthermore, the fluid chamber 16 which embraces the spindle housing 2 in an encircling manner by 360° on all sides is shown. The fluid chamber 16 communicates with the axial fluid outlet of the spindle housing 2. The fluid flowing out of the spindle housing 2 first of all passes into a corresponding deflection cavity 33 which, in the schematic illustration shown in FIG. 16, is provided on a base plate of the motor housing 34 but which can also be provided on an intermediate component 35 which is shown by dashed lines here because it is optional and which is in the form of a plate and ultimately provides a separate mounting interface for the drive motor 30. Said deflection cavity which is designed here as a pot-shaped depression or annular groove has a depression surface or base surface 36 of rounded configuration. The inflowing fluid is thereby deflected radially outwards and, via corresponding apertures 37 which are provided on a radial flange 38 of the spindle housing 2, flows axially back into the annular fluid chamber 16 in which the pump pressure therefore inevitably builds up. The latter causes a load on the spindle housing 2, and therefore the latter is stabilized and cannot change in its geometry as a result of pressure or operation. The fluid chamber 16, as already described, communicates with the fluid outlet port 10, and therefore the pressurized fluid can thereby be drawn off.

FIG. 16 is a pure schematic illustration. Of course, the connection of the deflection cavity 33 to the fluid chamber 16 can also be realized in a different manner than via the apertures 37 in the radial flange 28. Depending on the configuration of the spindle housing 2, a radial flange is not provided at this end if the spindle housing is supported radially elsewhere, or only if just a few radial protrusions are provided which undertake the support with respect to the outer housing 7, or similar.

Even if not illustrated specifically, of course one or more corresponding sealing elements are also found in the region of the connection of the drive motor 30 to the outer housing 7 or, if an intermediate component 35 is provided, in the region of the connection of this intermediate component 35 to the outer housing 7.

Finally, it should also be mentioned that the drive motor 30 can be either a dry-running rotor or a wet-running rotor. If it is a dry-running rotor, the drive shaft 31, shown only in stylized form here, of the drive motor 30, also shown only in stylized form here, is accommodated in a shaft sealing ring, and therefore fluid cannot flow along the drive shaft 31 and pass into the drive motor 30. The other sealing on this side takes place via the motor wall or the intermediate component 35. If it is a wet-running rotor which can be cooled by the fluid, no shaft sealing ring is located around the drive shaft 31, and therefore the fluid can flow along same.

While specific embodiments of the invention have been shown and described in detail to illustrate the inventive principles, it will be understood that the invention may be embodied otherwise without departing from such principles.

We claim:

1. A screw spindle pump, comprising:

a spindle housing having spindle bores, a fluid inlet and a fluid outlet;

a drive spindle;

at least one running spindle that meshes with the drive spindle, the drive spindle and the at least one running spindle being arranged in the spindle bores;

an outer housing that encloses the spindle housing;

a cover component releasably attached axially onto the outer housing via a plurality of bores in the cover component and a corresponding plurality of threaded bores in the outer housing, the plurality of bores and the plurality of threaded bores being arranged so that the cover component is fastenable to the outer housing in a plurality of marked rotational positions with a first pitch;

an axial fluid inlet port provided on the cover component;

a lateral fluid outlet port provided on the cover component, wherein the fluid inlet port communicates with the fluid inlet of the spindle housing and the fluid outlet port communicates with the fluid outlet of the spindle housing;

a plurality of first fastening elements provided on the cover component or provided on or in the outer housing; and second fastening elements provided on the spindle housing, said first fastening elements being configured to be engageable with the second fastening elements so that the spindle housing is fastenable to the cover component and/or in the outer housing in a plurality of marked rotational positions with a second pitch that is smaller than the first pitch, wherein the first fastening elements are positioned in a manner corresponding to the second pitch.

2. The screw spindle pump according to claim 1, wherein the first pitch is 90° and the second pitch is 45°.

3. The screw spindle pump according to claim 1, wherein two running spindles of the at least one running spindle are provided on either side next to the drive spindle.

4. The screw spindle pump according to claim 1, further comprising a support component arranged on the cover component, wherein the drive spindle and the at least one running spindle are supported axially on the support component.

5. The screw spindle pump according to claim 4, wherein the support component is a feather key which is positionable on the cover component in different marked rotational positions with the second pitch.

6. The screw spindle pump according to claim 5, wherein receiving grooves into which the feather key is insertable are provided on the cover component in a manner corresponding to the rotational positions with the second pitch.

7. The screw spindle pump according to claim 6, wherein the feather key is fixed by clamping in the receiving grooves.

8. The screw spindle pump according to claim 4, wherein the spindle housing, the outer housing and/or the cover component are made from plastic and the support component from metal.

9. The screw spindle pump according to claim 1, wherein the first fastening elements are depressions which are formed on the cover component and in which axial protrusions, which are provided on the spindle housing as the second fastening elements, engage, or the first fastening elements are axial protrusions which are provided on the cover component and engage in depressions which are formed on the spindle housing as the second fastening elements.

10. The screw spindle pump according to claim 1, wherein the first fastening elements are on the outer housing.

11. The screw spindle pump according to claim 1, further comprising a first sealing element arranged to seal the cover component in relation to the spindle housing and a second sealing element arranged to seal the cover component in relation to the outer housing.

12. The screw spindle pump according to claim 11, wherein a first axial receiving groove, into which the first sealing element is placed, is provided on the cover component or on the spindle housing, and a second radial receiving groove, into which the second sealing element is placed, is provided on the outer housing or on the cover component.

13. The screw spindle pump according to claim 1, wherein the fluid outlet of the spindle housing is an axial fluid outlet for a fluid which is delivered through the spindle housing via the drive spindle and the at least one running spindle and which communicates with a fluid chamber which is formed between the spindle housing and the outer housing, extends around 360° and, in turn, communicates with the fluid outlet port of the cover component.

14. The screw spindle pump according to claim 13, wherein the fluid chamber extends over at least half a length of the spindle bores.

15. The screw spindle pump according to claim 13, further comprising an intermediate component placed axially onto the outer housing and configured for connection of a drive motor, wherein at least one deflection cavity configured to deflect the fluid coming from the fluid outlet of the spindle housing to the fluid chamber is provided on the intermediate component.

16. The screw spindle pump according to claim 15, wherein the one or more deflection cavities is an annular groove or pot-like depression which has a round configuration in a region of a base of the annular groove or a base of the pot-like depression.

17. The screw spindle pump according to claim 13, further comprising a drive motor placed on the outer housing, the drive motor including a housing having at least one deflection cavity arranged to deflect the fluid coming from the fluid outlet of the spindle housing to the fluid chamber.

18. A motor vehicle comprising: the screw spindle pump according to claim 1 for delivering an operating liquid.

19. The motor vehicle according to claim 18, wherein the screw spindle pump is a coolant pump for delivering a coolant serving to cool an energy store.

* * * * *